United States Patent [19]

Gänzle et al.

[11] 4,263,701

[45] Apr. 28, 1981

[54] METHOD OF MOUNTING THE SUPPORT FOR A FAST WARM-UP CATHODE

[75] Inventors: Hartmut Gänzle, Neuhausen; Gunther Hänchen; Hermann Noller, both of Esslinger; Hans Reule, Wendlingen; Siegfried Spieth; Horst H. Vogel, both of Esslingen, all of Fed. Rep. of Germany

[73] Assignee: International Standard Electric Corporation, New York, N.Y.

[21] Appl. No.: 86,006

[22] Filed: Oct. 17, 1979

[30] Foreign Application Priority Data

Oct. 27, 1978 [DE] Fed. Rep. of Germany ..... 2846796

[51] Int. Cl.[3] ..... H01J 9/04

[52] U.S. Cl. ..... 29/25.15

[58] Field of Search ..... 29/25.13, 25.15, 25.14

[56] References Cited

U.S. PATENT DOCUMENTS

| | | | |
|---|---|---|---|
| 2,286,996 | 6/1942 | Dickinson | 29/25.15 |
| 2,551,871 | 5/1951 | Briggs, Jr. | 29/25.15 X |

*Primary Examiner*—Richard B. Lazarus

*Attorney, Agent, or Firm*—John T. O'Halloran; Robert A. Walsh

[57] ABSTRACT

The cathode support of an indirectly heated cathode for picture tubes is commonly mounted in a ceramic disk by cold riveting. With sheet thicknesses below 0.1 mm, the support cracks during riveting. According to the invention, that portion of the support which projects beyond the ceramic disk is first rolled over by wobble-riveting, after which the support is braced by hot-pressing. This insures that the cathode support is securely held in place and prevents cracking.

6 Claims, 4 Drawing Figures

METHOD OF MOUNTING THE SUPPORT FOR A FAST WARM-UP CATHODE

BACKGROUND AND SUMMARY OF THE INVENTION

The present invention relates to a method of mounting the support for a cathode in a hole of an insulating part against one side of which the support rests with a bulge. Such cathode structures are used, for example, in electron-gun systems of picture tubes. Such a cathode, illustrated in FIG. 1 of the accompanying drawing, is shown, for example, in the figure of German Auslegeschrift (DE-AS) No. 23 13 911, and its principle is described in an article by M. Tischer, "Die Oxidkathode in der Bildrohre", periodical "Funkschau", 1967, No. 21, pp. 675–677

From British Pat. No. 725,250 it is known to pass a tubular cathode through a hole in an insulating disk until the disk is located against a bulge on the cathode, and to subsequently bend over the projecting portion of the cathode along its entire circumference. With the progress in cathode-ray tube technology, ever shorter warm-up times have been required. Instead of mounting the cathode directly in the insulating disk, it is, therefore, common practice to connect the cathode to the insulating disk by means of a cathode support, keeping heat conduction to a minimum. This step results in a considerable reduction in warm-up time, which is why such cathodes are also called "fast warm-up cathodes".

In conventional designs, the cathode support is mounted in the hole of the insulating part, usually a ceramic material, by cold riveting. That portion of the cathode support which projects beyond the hole is bent over by means of a punch, and at the same time the cathode support is slightly upset so as to be firmly fixed in the hole. The material for the cathode and cathode support is so chosen as to insure optimum workability during riveting.

To further reduce the warm-up time, the heat capacity of the cathode support and the thermal conductivity of the material of which the support is made have been further decreased. In the case of wall thicknesses of $<0.1$ mm and/or if a hard-to-deform material such as Ni 80 Cr 20 is used, longitudinal cracks are formed in the bending area which greatly reduce the stability of the mount. When forming the bulge with which the cathode support rests against the insulating part, similar problems arise, but it is readily possible to take special measures during the production of these semi-fabricated components to prevent cracking, such as very high temperatures in the area where the bulge is formed.

Cathode supports having such thin walls and made of hard-to-deform materials such as the aforementioned Ni 80 Cr 20 are increasingly used in so-called fast warm-up cathodes, in which the cathode support should have a low thermal conductivity and a low thermal capacity.

In addition, cathode supports not securely held in the ceramic part result in unstable cathode temperatures because of the varying heat transfer.

The object of the invention is to provide a method whereby very thin-walled cathode supports, even if made of hard-to-deform material, can be mounted without any cracks forming in the bent portion and which simultaneously ensures that the cathode support is securely held in the opening of the ceramic disk.

This object is achieved by the means set forth in the claims.

Besides permitting the use of materials which are difficult to work or have a small wall thickness, the method claimed has the advantage of considerably stabilizing the cathode temperature as a result of a well reproducible heat transfer from the cathode support to the ceramic material. Even at high operating temperatures, the cathode support will no longer come loose.

BRIEF DESCRIPTION OF THE DRAWING

The invention will now be explained in greater detail with reference to the accompanying drawing, in which.

DETAILED DESCRIPTION OF THE PREFERRED EMBODIMENT

Figure 1:
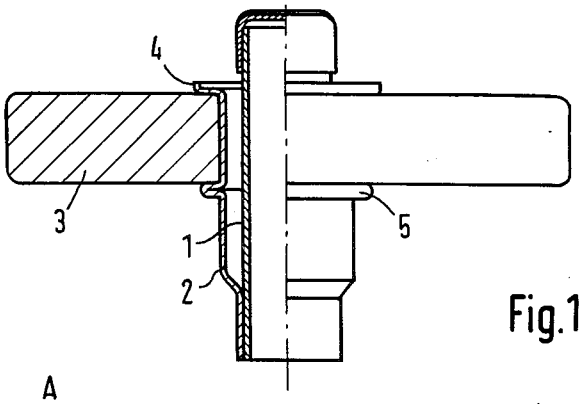
Fig.1 (PRIOR ART)
FIG. 1 shows a prior art cathode structure.

In the cathode structure shown in FIG. 1, the reference numeral 1 denotes a cathode sleeve. A cathode support and a ceramic disk are designated 2 and 3, respectively. In the first step of the invention, shown in FIG. 2, the bent portion 4 is formed. In many cases, regardless of the joining technique used, a metal shim is placed under the bent portion 4 to prevent the edge of the hole in the ceramic disk from breaking off, and cathode material from depositing on the ceramic disk. However, this disk does not form an essential part of the invention and, therefore, has been omitted in all figures.

The wobble-riveting technique illustrated in FIG. 2 is suitable for bending over even cathode supports made of hard-to-draw material, such as Ni 80 Ci 20, or having a very small wall thickness, without cracking.

Figure 2A:
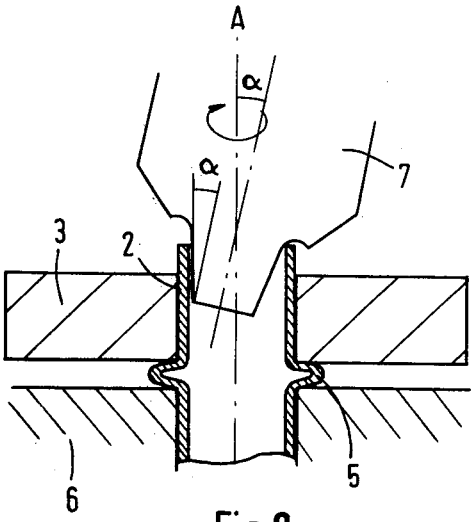
FIGS. 2*a* and 2*b* show the wobble-riveting.
Figure 2B:
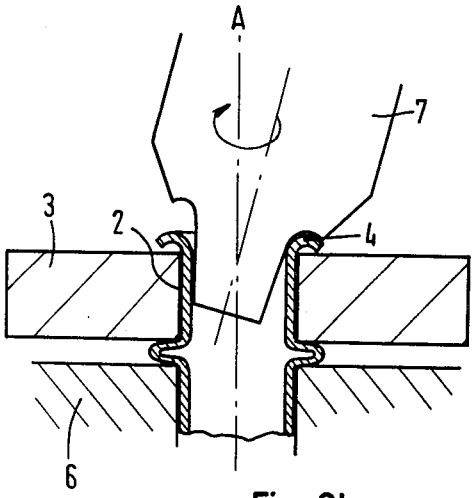

FIG. 2*a* shows the beginning, and FIG. 2*b* the end, of the bending by the wobble-riveting technique. The cathode support 2 is again placed with the bulge 5 on a base 6, which gives a firm support. The punch 7 performs two movements at the same time:

a conical movement about the axis

A at an angle $\alpha$, and a feed movement in the direction of the axis A.

The feed must be about 0.55 mm, and this is achieved with about 100 revolutions. Alcohol is used as a lubricant. The process takes about 1 sec.

Advantageously, the punch is designed so that the thin-walled tube is supported on one side while being bent on the other.

In FIGS. 2*a* and 2*b*, the cathode support is supported by the punch on the left-hand side, while the right-hand side is bent over. During the conical movement of the punch, the supporting surface and the bending area move around the cathode support.

As can be seen from FIG. 2*a*, this supporting effect is produced if the lower, conical portion of the punch is of a suitable diameter and if its circumferential surface makes an angle $\alpha$ with the axis of the punch, with $\alpha$ corresponding to the angle by which the axis of the punch is tilted against the axis A of the cathode support. In practice, $\alpha$ lies between 2° and 10°.

After the bending has been accomplished by this wobble-riveting technique even under the less favorable circumstances described, which make conventional cold riveting impossible, a second step is taken which insures that the cathode support is free from play even at elevated operating temperatures.

Figure 3:
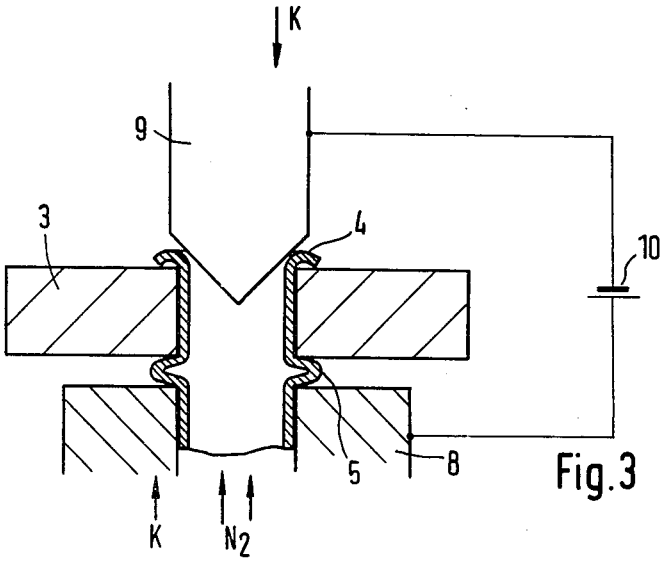
FIG. 3 shows the hot-pressing.

This is achieved by hot-pressing, as shown in FIG. 3. The numerical data given in the following refer to a practical embodiment.

First the cathode support 2 is placed with its bulge 5 on the metallic holder 8. The metallic point 9 then presses on the ring 4 with a force K of 4–10 kgf. The point is a right circular cone. At the same time, the flushing with an inert gas, preferably $N_2$, is started to prevent the cathode support from oxidizing during the subsequent heating process.

A voltage of 1–5 V is then applied to the point 9 and the holder 8. The voltage is adjusted so that the cathode support is heated to a dark red heat. The cathode support tries to expand but is prevented from doing so by the holder 8 and the point 9, thus being braced in the ceramic disk. The voltage is turned off. After a time delay in which the cathode support cools down to below 200° C., the flushing with nitrogen is switched off and the force K is removed.

The hot-pressing takes about 1 sec. Instead of resistance heating, the method used to heat the cathode support may be induction heating or any other heating method. It does not suffice to heat a hard-to-deform, thin-walled metal part as is preferably used for cathode supports with current and then deform it only by a pressing technique, because the cathode support would be deformed so that the mounting mandrel to be used in the next operation could no longer be inserted into the cathode support. The preceding bending by the wobble-riveting technique described is indispensable.

The bending by wobble-riveting and the subsequent hot-pressing result in a perfect, tight fit of the cathode support in the insulating part, even at high operating temperatures.

We claim:

1. An improved method of connecting a fast warm-up cathode with an insulating part by mounting a cylindrical cathode support in a hole of the insulating part, against one side of which the cathode support rests with a bulge, and against the other side of which the cathode support rests with a bent portion along its entire circumference, wherein the improvement comprises, in combination:

(A) bending over the projecting end of the cathode support (2) by a wobble-riveting technique, and (B) subsequently bracing the cathode support (2) by hot-pressing, which is done by applying pressure and heat simultaneously to the bulge (5) and the bent portion (4) of the cathode support.

2. A method as claimed in claim 1, wherein the temperature at which the hot-pressing is performed corresponds to a beginning red heat.

3. A method as claimed in claim 1, wherein the cathode support is heated by resistance heating.

4. A method as claimed in claim 1, wherein the cathode support is heated by induction heating.

5. A method as claimed in claim 1, wherein during the hot-pressing, the cathode support is flushed with inert gas.

6. A method as claimed in claim 5, wherein the inert gas is $N_2$.

* * * * *